United States Patent [19]

Wesselink et al.

[11] 4,237,400

[45] Dec. 2, 1980

[54] LOW-PRESSURE DISCHARGE LAMP WITH TORTUOUS DISCHARGE PATH

[75] Inventors: Gustaaf A. Wesselink; Hendrik Roelofs; Cornelis H. M. Van Bommel, all of Eindhoven, Netherlands

[73] Assignee: U.S. Philips Corporation, New York, N.Y.

[21] Appl. No.: 13,587

[22] Filed: Feb. 21, 1979

[30] Foreign Application Priority Data

Mar. 8, 1978 [NL] Netherlands ..... 7802511

[51] Int. Cl.[3] ..... H01J 61/10; H01J 61/30

[52] U.S. Cl. ..... 313/204; 313/493; 313/220

[58] Field of Search ..... 313/204, 493, 220 (U.S. only)

[56] References Cited

U.S. PATENT DOCUMENTS

| | | | |
|---|---|---|---|
| 3,849,689 | 11/1974 | Campbell | 313/493 X |
| 4,095,135 | 6/1978 | Yamazaki et al. | 313/220 X |

*Primary Examiner*—Robert Segal

*Attorney, Agent, or Firm*—Robert S. Smith

[57] ABSTRACT

Low-pressure discharge lamp having a discharge space, limited by an elongate lamp vessel, electrodes at one end of the vessel in the discharge space between which electrodes a discharge takes place during operation of the lamp. The lamp vessel has partitions to divide the discharge space into each extending substantially in the length of the discharge vessel which chambers communicate with one another via at least one opening. The chambers are sequentially passed through by the discharge, the opening between at least two chambers being at least partly wedge-shaped, the minimum width being located nearest to an electrode whose discharge path extends itself after ignition.

4 Claims, 4 Drawing Figures

LOW-PRESSURE DISCHARGE LAMP WITH TORTUOUS DISCHARGE PATH

Figure 1:
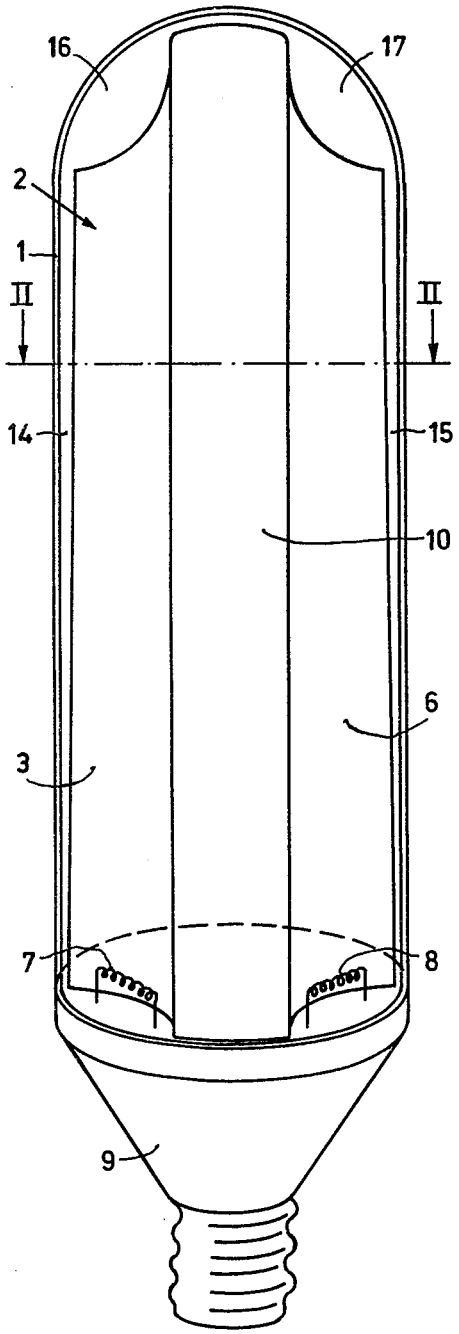

The invention relates to a low-pressure discharge lamp having a discharge space limited by an elongate lamp vessel, electrodes between which electrodes a discharge is effected during operation of the lamp, the lamp vessel having at least one partition therein which divides the discharge space into chambers, each extending substantially the length of the vessel which chambers communicate with one another via an opening at least partly formed in each of the partitions, whereby the chambers are sequentially passed through by the discharge. Such a lamp is disclosed in German Pat. Spec. No. 889,951.

If the discharge path has been folded a compact low pressure discharge lamp, such as a low-pressure mercury vapor discharge lamp or a low pressure sodium vapour discharge lamp can be obtained. If provided with a suitable lamp base such lamps are suitable for use in luminaires for incandescent lamps for general lighting purposes.

The above-mentioned German Pat. Spec. describes a low-pressure discharge lamp wherein the discharge space is divided into one or more chambers by means of partitions, the discharge path being extended by folding. The Pat. Spec. proposes to produce the partitions of flexible material so that they press against the inner wall of the lamp envelope and constitute a discharge-light connection to prevent short-circuiting of the discharge along the edges of the partitions from occurring during operation.

These lamps have the advantage of being relatively small and easy to handle. Added to this is the fact that folding the discharge path provides a relatively long discharge path so that at a given applied power the operating voltage is relatively high and the lamp current relatively low. As a result the energy losses at the electrodes are relatively low and the dimensions of the necessary electric ballast are small, so that the efficiency of the compact lamp is relatively high.

However, a drawback of the above-specified lamps is that the starting voltage of the lamp is high owing to the relatively long discharge path. This requires additional provisions to facilitate starting. Examples of such provisions are electrically conducting strips or layers between the electrodes on the wall of the lamp vessel or the application, near the electrodes, of an amalgam from which mercury is released immediately after starting.

It is an object of the invention to provide a low-pressure discharge lamp which has such a construction that the above-mentioned starting problems are at least mitigated to a considerable extent.

In accordance with the invention a low-pressure discharge lamp of the type defined in the preamble is characterized in that at least one said opening has a wedge-shaped portion extending towards the electrodes with the point of minimum thickness of the wedge located near an electrode as a result of which the discharge path extends itself after starting.

The presence of a wedge-shaped opening in the partition reduces the starting voltage. Namely, the starting discharge follows the shortest path between two chambers through the narrowest portion of the wedge, the latter being located close to an electrode. The electric field strength and the degree of ionization of the discharge increases in that portion of the wedge whereafter, because of the fact that the angle of the wedge is very acute, the discharge rapidly shifts to a wider portion of the wedge until the end of the wedge is reached and the discharge obtains its desired shape. The desired shape must here be understood to means the shape the discharge part would have without the presence of a wedge. The discharge then passes along the entire length of the chambers.

The wedge preferably has an angle which is between 0.25° and 3°. Much smaller angles are little efficient because then the slit width near the electrode is so small that no brief short-circuit occurs. At larger angles it is less certain that the discharge extends after ignition to its desired shape.

In an embodiment of a lamp according to the invention the wedge-shaped portion of the opening is formed partly by the wall of the lamp vessel and partly by an adjacent portion of the partition. This embodiment has the advantage that the wedge-shaped opening can be provided in a simple manner. It is then not necessary for the system of partitions and the enveloping lamp vessel to nest accurately together but they may be located with respect to one another with a relatively large tolerance.

In one embodiment having two partitions each partition has a double wall the edges of which adjacent the lamp vessel are interconnected by an end wall facing the wall of the lamp vessel, at least one of said end walls constituting a wedge-shaped opening with the lamp vessel wall. This embodiment also has the advantage that the system of partitions, for example consisting of a hollow cylindrical member having a plurality of grooves in which the discharge takes place can be placed in a simple manner and with a relatively large tolerance in the cylindrical lamp envelope. Lamps provided with partitions having such end walls have the advantage that at least some of the light or radiation, generated in the chambers or grooves and transmitted generally towards the lamp axis can leave the lamp through said end walls. At the same time shortcircuiting between the chambers during operation of the lamp is prevented from occurring because the very thin wedge-shaped openings formed between the end walls and the lamp vessel have a relatively high electric field strength due to their long width dimension.

In another embodiment the lamp vessel contains a single plate partition having a central wedge-shaped opening extending in the axial direction of the lamp. In this embodiment the electrodes are preferably disposed adjacent to one another on either side of the partition. Because the wedge-shaped opening is in the center of the partition the shortest possible connecting path between the electrodes can then be utilized. Such a lamp having a glass partition can be produced by starting from a partition having a slit of a constant width over its overall length. Thereafter such forces are exercised on the lamp vessel wall by means of pressing jigs, the wall being heated at the same time that a wedge-shaped slit is obtained. The surface roughnen of the edge of a wedge produced in this manner is the lowest possible so that the gradual shift of the discharge along the wedge to its desired shape is disturbed as little as possible during starting of the lamp.

Lamps according to the invention may be used as an alternative for incandescent lamps. The dimensions of lamps according to the invention can be substantially the same as those of incandescent lamps of comparible light output, in which case the efficiency of the discharge lamps is a few times greater. By a suitable choice of the luminescent material a color temperature can be achieved with low-pressure mercury vapor discharge lamps according to the invention which corresponds to that of an incandescent lamp; this renders the use of the small discharge lamps according to the invention in living rooms attractive, the more so as the lamps start readily.

An embodiment of a lamp according to the invention will further by way of example be explained with reference to a drawing.

In the drawing

Figure 2:
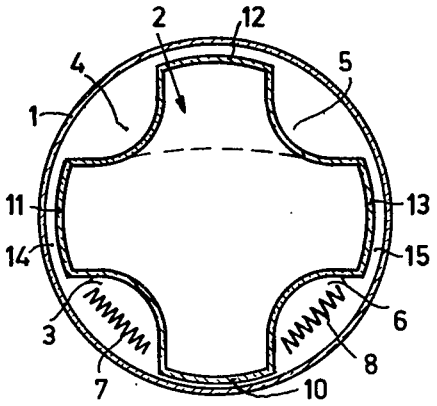
Figure 3:
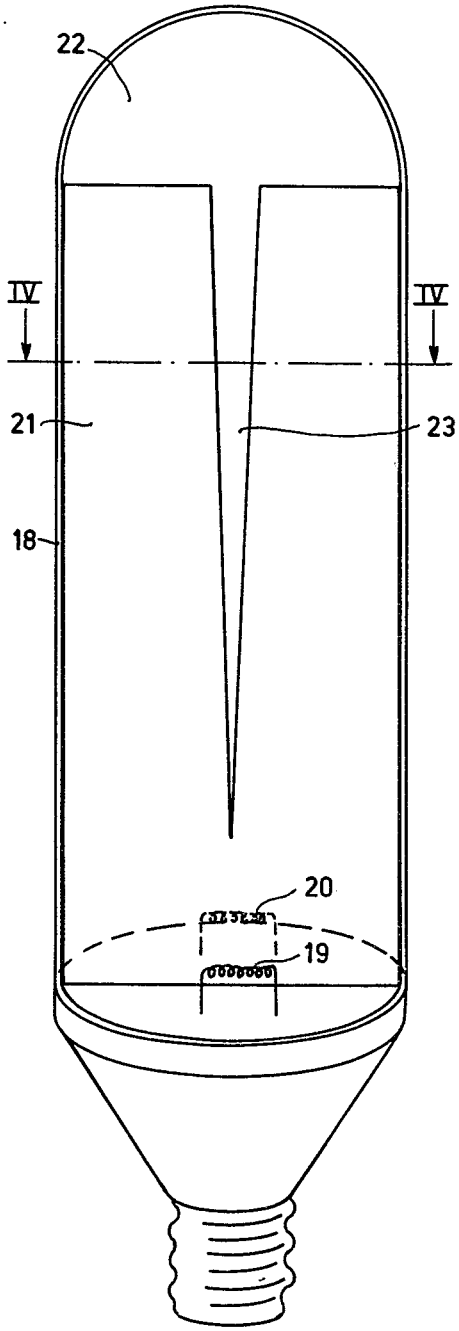
Figure 4:
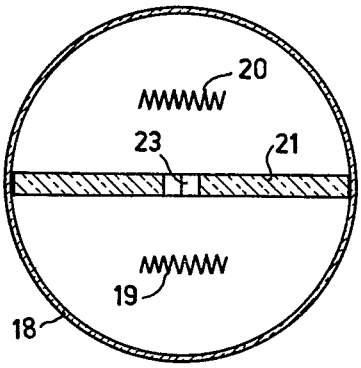

FIG. 1 shows an embodiment of a low-pressure discharge lamp according to the invention wherein the chambers present in the lamp vessel are separated by double walled partitions; and FIG. 2 shows a cross-section along the plane II—II of the lamp shown in FIG. 1, FIG. 3 shows an embodiment of a low-pressure discharge lamp according to the invention wherein the lamp vessel contains two chambers separated by one partition;

FIG. 4 shows a cross-section of a lamp shown in FIG. 3.

The low-pressure discharge lamp shown in the FIGS. 1 and 2 comprises a cylindrical glass lamp vessel 1,, which limits the discharge space. The lamp vessel has four communicating chambers 3, 4, 5 and 6 through which the discharge passes sequentially during operation of the lamp. The chambers are limited by the walls of the grooves in a glass inner member 2 and the wall of the lamp vessel. The electrodes (denoted by 7 and 8) are located at the same end of the lamp near the lamp base 9 wherein a starter and/or ballast and the connecting members for the electric connection of the lamp are disposed. The chambers are separated from one another along their length by double-walled partitions whose edges near the lamp vessel are inter connected by end walls. These end-walls are denoted by 10, 11, 12 and 13. At least some of the light generated in the grooves or chambers 3, 4, 5 and 6 (such as sodium light or, in low-pressure mercury vapor discharge lamps, ultraviolet radiation converted into visible light by luminescent layers) and emitted in the general direction toward, the longitudinal axis of the lamp, can then leave the lamp through said end walls. Respective wedge-shaped openings 14 and 15, extend between the chambers 3 and 4 and between the chambers 5 and 6, in the longitudinal direction of the lamp. The wedge-shaped opening being formed between the end walls 11 and 13, respectively and the lamp vessel wall.

The end wall 12 located between the chambers 4 and 5 extends in parallel with the lamp vessel wall. The end wall 10 located between the chambers 3 and 6 also extends in parallel with the lamp vessel wall, but is located at a much shorter distance from the lamp vessel wall than end wall 12, becase otherwise a short-circuit between the electrodes 7 and 8 would occur.

On starting of the lamp the discharge takes the shortest path between the electrodes 7 and 8, while passing through all chambers. For example, the discharge travels from electrode 7 through the lower end of the wedge shaped opening 14 to chamber 4, through a communicaty passage (shown in broken outline in FIG. 2) to chamber 5 and then through the lower end of the wedge-shaped opening 15 to electrode 8. As the degree of ionization of the discharge increases so the discharge creeps upwards along the wedge-shaped openings 14, 15 and finally extends via communicating passages 16, 17 and hence passes through the entire length of all the chambers 3 to 6. During operation of the lamp the discharge maintains this path, i.e. it travels upwards (see FIG. 1) from electrode 7 through groove or chamber 3, through passage 16, down again through chamber 4, through the passage between chambers 4 and 5 near the base 9, upwards through chamber 5, through passage 17 and then through chamber 6 to electrode 8.

In a practical embodiment of a low-pressure mercury vapor discharge lamp the overall length is approximately 15 cm. The diameter of the cylindrical lamp vessel is approximately 9 cm. The maximum depth of the chambers is which the discharge takes place is approximately 1.5 cm. The ends walls are approximately 1.8 cm wide. The spacing between the end wall 12 and the lamp vessel wall is approximately 2 mm. The spacing between end wall 10 (located between the two electrodes) and the vessel wall is 0.2 mm. This spacing is constant for these two end-walls over the overall lamp length. However, the end-walls 11 and 13 form, with the wall of the lamp vessel the wedge-shaped openings 14 and 15 having a wedge-angle of approximately 1.5° C. The wedge thickness varies from 20 μm near the filaments to 1.5 mm at the top. The overall length of the discharge path is approximately 40 cm. The portions of the lamp vessel wall enclosing the discharge path and the walls of the grooves 3 to 6 in the inner member 2 are provided with a luminescent layer, for example consisting of a mixture of three phosphors, namely blue-luminescing, bivalent europium-activated barium magnesium aluminate, green-luminescing, terbium-activated cerium magnesium aluminate and redluminescing, trivalent europium-activated yttrium-oxide. The end walls and the adjacent portions of the lamp vessel are free from luminescent material. The lamp vessel contains mercury as well as an argon-neon (75-25) vol % mixture at a pressure of 2.5 torr. At a supplied power to the lamp of 20 W and an operating voltage of 100 V the efficiency of the lamp was 62 lm/W.

In FIGS. 3 and 4 the cylindrical lamp vessel is denoted by 18. Two adjacent electrodes 19 and 20 are present at one end of the lamp vessel. Between these electrodes there is a transverse partition 21 three edges whereof form a discharge-tight connection with the lamp vessel wall. This transverse partition divides the lamp vessel into two chambers which communicate via opening 22. In the transverse partition there is a wedge-shaped opening 23 the minimum width of which is located near the electrodes. The wedge angle of this opening is approximately 0.5°. The maximum width of the wedge (adjacent the opening 22) is 1 mm. On starting the lamp, the discharge takes the shortest path between the electrodes through the narrowest portion of the wedge. Owing to the increase in the degree of ionization then occurring the discharge moves upwards through opening 22 until it has its desired shape. The partition 21 is approximately 2 mm thick. A layer of manganese and antimony-activated calcium halophosphate is present on the inner wall of the lamp envelope 18. The lamp vessel is approximately 25 cm long, its diameter is approximately 4 cm. At a rare gas pressure (argon-neon 75-25 Vol.%) of 2.5 torr and a mercury vapor pressure of approximately $10_{-2}$ torr the efficiency was 55 lm/W at a supplied power to the lamp of 20 W.

What is claimed is:

1. A low-pressure discharge lamp having a discharge space limited by an elongate lamp vessel, first and second electrodes disposed at one end of said vessel, an ionizable medium in said vessel, means for directing a discharge between said first and second electrodes and repetitively between the ends of said vessel, said means for directing including said lamp vessel having at least one partition therein which divides the discharge space into chambers each extending substantially the length of the lamp vessel, said chambers communicating with one another through an opening at least partly formed in each of the partitions, each successive opening between two chambers being disposed at a different end, at least one opening being located at the end of the vessel remote from the electrodes and has a wedge-shaped portion extending towards the electrodes with the point of minimum thickness of the wedge located near an electrode as a result of which the discharge path extends itself after ignition of the lamp.

2. A low-pressure discharge lamp as claimed in claim 1 wherein the wedge-shaped portion of the opening is formed partly by the wall of the lamp vessel and partly by an ajacent portion of the partition.

3. A low pressure discharge lamp as claimed in claim 2 wherein each partition has a double wall the edges of which adjacent the lamp vessel are interconnected by an end wall facing the lamp vessel wall, at least one of said end walls constituting a wedge-shaped opening with the lamp vessel wall.

4. A low pressure discharge lamp as claimed in claim 1 wherein the lamp vessel contains a single plate partition having a central wedge-shaped opening therein extending in the axial direction of the lamp.

* * * * *